US009282419B2

(12) United States Patent
Sun et al.

(10) Patent No.: US 9,282,419 B2
(45) Date of Patent: Mar. 8, 2016

(54) AUDIO PROCESSING METHOD AND AUDIO PROCESSING APPARATUS

(71) Applicant: Dolby Laboratories Licensing Corporation, San Francisco, CA (US)

(72) Inventors: Xuejing Sun, Beijing (CN); Glenn Dickins, Como (AU); Huiqun Deng, Beijing (CN); Zhiwei Shuang, Beijing (CN); Bin Cheng, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 17 days.

(21) Appl. No.: 14/365,072

(22) PCT Filed: Dec. 12, 2012

(86) PCT No.: PCT/US2012/069303

§ 371 (c)(1),
(2) Date: Jun. 12, 2014

(87) PCT Pub. No.: WO2013/090463

PCT Pub. Date: Jun. 20, 2013

(65) Prior Publication Data

US 2015/0071446 A1 Mar. 12, 2015

Related U.S. Application Data

(60) Provisional application No. 61/586,945, filed on Jan. 16, 2012.

(30) Foreign Application Priority Data

Dec. 15, 2011 (CN) ..... 2011 1 0421777

(51) Int. Cl.
*H04S 5/00* (2006.01)
*G10L 21/0364* (2013.01)
(Continued)

(52) U.S. Cl.
CPC . *H04S 5/00* (2013.01); *G10L 19/26* (2013.01); *G10L 21/0364* (2013.01); *H04S 7/302* (2013.01)

(58) Field of Classification Search
CPC ..... H04S 3/00; H04S 5/00; H04S 5/005; H04S 7/00; H04S 7/302; H04S 1/002; H04S 1/005; H04R 5/00; G10L 19/26; G10L 19/008
USPC ..... 381/1, 17, 18, 63
See application file for complete search history.

(56) References Cited

U.S. PATENT DOCUMENTS 7,391,877 B1 6/2008 Brungart
7,761,291 B2 7/2010 Renevey
(Continued)

FOREIGN PATENT DOCUMENTS

KR 2009-0090693 8/2009
WO 2010/004473 1/2010

OTHER PUBLICATIONS

Edmonds, B.A. et al "The Role of Head-Related Time and Level Cues in the Unmasking of Speech in Noise and Competing Speech" Acta Acustica United with Acustica, vol. 91, No. 3, pp. 546-553, published by S. Hirzel on May-Jun. 2005.
(Continued)

*Primary Examiner* — Paul S Kim
*Assistant Examiner* — Sabrina Diaz

(57) ABSTRACT

An audio processing method and an audio processing apparatus are described. A mono-channel audio signal is transformed into a plurality of first subband signals. Proportions of a desired component and a noise component are estimated in each of the subband signals. Second subband signals corresponding respectively to a plurality of channels are generated from each of the first subband signals. Each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method. The second subband signals are transformed into signals for rendering with the multi-dimensional auditory presentation method. By assigning different hearing properties to desired sound and noise, the intelligibility of the audio signal can be improved.

20 Claims, 6 Drawing Sheets

(51) Int. Cl.
*G10L 19/26* (2013.01)
*H04S 7/00* (2006.01)

(56) References Cited

U.S. PATENT DOCUMENTS

| | | | |
|---|---|---|---|
| 2006/0133619 | A1 | 6/2006 | Curry |
| 2008/0008341 | A1 | 1/2008 | Edwards |
| 2008/0232603 | A1 | 9/2008 | Soulodre |
| 2009/0304203 | A1 | 12/2009 | Haykin |
| 2010/0002886 | A1 | 1/2010 | Doclo |
| 2010/0316232 | A1 | 12/2010 | Acero |
| 2011/0119061 | A1 | 5/2011 | Brown |

OTHER PUBLICATIONS

Culling, J.F. et al "The Role of Head-Induced Interaural Time and Level Differences in the Speech Reception Threshold for Multiple Interfering Sound Sources" Journal of the Acoustical Society of America, vol. 116, No. 2, pp. 1057-1065, Aug. 2004.

Shinn-Cunningham, B.G., et al "Spatial Unmasking of Nearby Speech Sources in a Simulated Anechoic Environment" Journal of the Acoustical Society of America, vol. 110, No. 2, pp. 1118-1129, Aug. 2001.

Sun, X. et al "Robust Noise Estimation Using Minimum Correction with Harmonicity Control" In Proceeding of: Interspeech 2010, 11th Annual Conference of the International Speech Communication Association, Japan, Sep. 26-30, 2010.

Dirks, D.D. et al "The Effect of Spatially Separated Sound Sources on Speech Intelligibility" Journal of Speech and Hearing Research, American Speech-Language-Hearing Association, vol. 12, No. 1, Mar. 1, 1969, pp. 5-38.

Hirsh, Ira "The Relation Between Localization and Intelligibility" The Journal of the Acoustical Society of America, vol. 22, No. 2, Mar. 1950, p. 200.

AUDIO PROCESSING METHOD AND AUDIO PROCESSING APPARATUS

CROSS-REFERENCE TO RELATED APPLICATIONS

This application claims priority to Chinese Patent Application No. 201110421777.1 filed 15 Dec. 2011 and U.S. Provisional Patent Application No. 61/586,945 filed 16 Jan. 2012, hereby incorporated by reference in their entireties for all purposes.

TECHNICAL FIELD OF THE INVENTION

The present invention relates generally to audio signal processing. More specifically, embodiments of the present invention relate to audio processing methods and audio processing apparatus for audio signal rendering based on a mono-channel audio signal.

BACKGROUND OF THE INVENTION

In many audio processing applications, a mono-channel audio signal may be received and sound is output based on the mono-channel audio signal. As an example, in a voice communication system, voice is captured as a mono-channel signal by a voice communication terminal A. The mono-channel signal is transmitted to a voice communication terminal B. The voice communication terminal B receives and renders the mono-channel signal. As another example, a desired sound such as speech, music and etc. may be recorded as a mono-channel signal. The recorded mono-channel signal may be read and played back by a playback device.

To increase intelligibility of desired sounds to audience, noise reduction methods such as Wiener filtering may be used to reduce noise, so that the desired sounds in the rendered signal can be more intelligible.

SUMMARY OF THE INVENTION

According to an embodiment of the invention, an audio processing method is provided. According to the method, a mono-channel audio signal is transformed into a plurality of first subband signals. Proportions of a desired component and a noise component are estimated in each of the subband signals. Second subband signals corresponding respectively to a plurality of channels are generated from each of the first subband signals. Each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method. The second subband signals are transformed into signals for rendering with the multi-dimensional auditory presentation method.

According to an embodiment of the invention, an audio processing apparatus is provided. The apparatus includes a time-to-frequency transformer, an estimator, a generator, and a frequency-to-time transformer. The time-to-frequency transformer is configured to transform a mono-channel audio signal into a plurality of first subband signals. The estimator is configured to estimate proportions of a desired component and a noise component in each of the subband signals. The generator is configured to generate second subband signals corresponding respectively to a plurality of channels from each of the first subband signals. Each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method. The frequency-to-time transformer is configured to transform the second subband signals into signals for rendering with the multi-dimensional auditory presentation method.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION OF THE INVENTION

Figure 1:
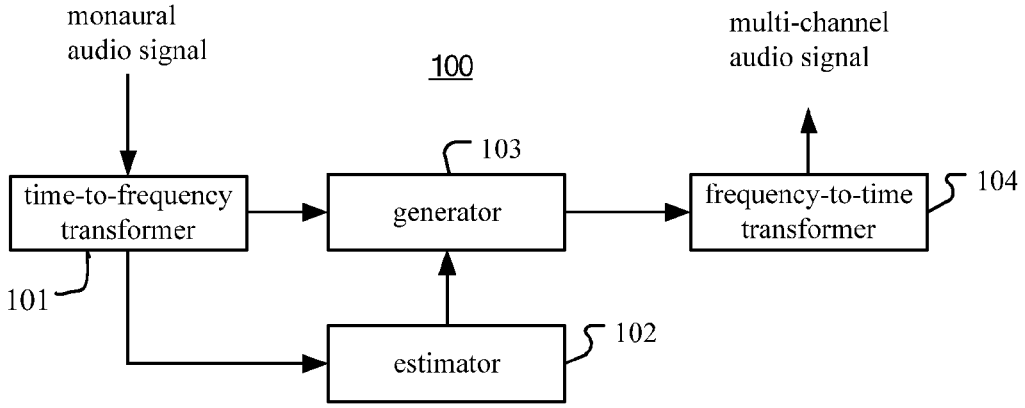
FIG. 1 is a block diagram illustrating an example audio processing apparatus according to an embodiment of the invention.

The embodiments of the present invention are below described by referring to the drawings. It is to be noted that, for purpose of clarity, representations and descriptions about those components and processes known by those skilled in the art but not necessary to understand the present invention are omitted in the drawings and the description.

As will be appreciated by one skilled in the art, aspects of the present invention may be embodied as a system, a device (e.g., a cellular telephone, portable media player, personal computer, television set-top box, or digital video recorder, or any media player), a method or a computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 is a block diagram illustrating an example audio processing apparatus 100 according to an embodiment of the invention.

As illustrated in FIG. 1, the audio processing apparatus 100 includes a time-to-frequency transformer 101, an estimator 102, a generator 103 and a frequency-to-time transformer 104. In general, segments s(t) of a mono-channel audio signal stream are input to the audio processing apparatus 100, where t is the time index. The audio processing apparatus 100 processes each segment s(t) and generates corresponding multi-channel audio signal S(t). The multi-channel audio signal S(t) is output through an audio output device (not illustrated in the figure). The segments are also called as mono-channel audio signals hereafter.

For each mono-channel audio signal s(t), the time-to-frequency transformer 101 is configured to transform the mono-channel audio signal s(t) into a number K of subband signals (corresponding to K frequency bins) D(k,t), where k is the frequency bin index. For example, the transformation may be performed through a fast-Fourier Transform (FFT).

The estimator 102 is configured to estimate proportions of a desired component and a noise component in each subband signal D(k,t).

A noisy audio signal may be viewed as a mixture of a desired signal and a noise signal. If the human auditory system is able to extract the sound corresponding to the desired signal (also called as desired sound) from the interference corresponding to the noise signal, the audio signal is intelligible to the human auditory system. For example, in voice communication applications, the desired sound may be speech, and in recording and playback applications, the desired sound may be music. In general, depending on specific applications, the desired sound may comprise one or more sounds that audience wants to hear, and accordingly, the noise may include one or more sounds that the audience does not want to hear, such as stationary white or pink noise, non-stationary babble noise, or interference speech, etc. Based on specific spectrum characteristics of the desired signal and the noise signal, it is possible to adopt an appropriate method to estimate proportions of the desired component corresponding to the desired signal and the noise component corresponding to the noise signal in each subband signal. The proportions of the desired component and the noise component may be estimated independently. Alternatively, in case of knowing one of the proportions, it is possible to obtain another proportion by regarding the remaining portion other than the estimated desired component as the noise component, or regarding the remaining portion other than the estimated noise component as the desired component.

In an example, the proportions of the desired component and the noise component may be estimated as a gain function. Specifically, it is possible to track the noise component in the audio signal to estimate a noise spectrum, and derive a gain function G(k,t) for each subband signal D(k,t) from the estimated noise spectrum and the subband signal D(k,t).

In general, the desired (e.g., speech) component $\hat{S}(k,t)$ may be obtained based on its proportion, for example, the gain function G(k,t). In case of gain function, the desired component $\hat{S}(k,t)$ may be obtained as below:

$$\hat{S}(k,t)=G(k,t)D(k,t) \quad (1).$$

The proportion of the noise component may be estimated as (1−G(k,t)). The noise component $\hat{N}(k,t)$ may be obtained as below:

$$\hat{N}(k,t)=(1-G(k,t))D(k,t) \quad (2).$$

Various gain functions may be used, including but not limited to spectral subtraction, Wiener filter, minimum-mean-square-error log spectrum amplitude estimation (MMSE-LSA).

In an example of spectral subtraction, a gain function $G_{SS}(k,t)$ may be derived as below:

$$G_{SS}(k,t)=\left(\frac{R_{PRIO}(k,t)}{1+R_{PRIO}(k,t)}\right)^{0.5}. \quad (3)$$

In an example of Wiener Filter, a gain function $G_{WIENER}(k,t)$ may be derived as below:

$$G_{WIENER}(k,t)=\frac{R_{PRIO}(k,t)}{1+R_{PRIO}(k,t)}. \quad (4)$$

In an example of MMSE-LSA, a gain function $G_{MMSE\text{-}LSA}(k,t)$ may be derived as below:

$$G_{MMSE-LSA}(k,t)=\frac{R_{PRIO}(k,t)}{1+R_{PRIO}(k,t)}\exp\left(0.5\int_{v(k,t)}^{\infty}\frac{e^{-t'}}{t'}dt'\right), \quad (5)$$

where $$v(k,t)=\frac{R_{PRIO}(k,t)}{1+R_{PRIO}(k,t)}R_{POST}(k,t). \quad (6)$$

In the above examples, $R_{PRIO}(k,t)$ represents a priori SNR, and may be derived as below:

$$R_{PRIO}(k,t)=\frac{P_{\hat{S}}(k,t)}{P_N(k,t)}, \quad (7)$$

$R_{POST}(k,t)$ represents a posteriori signal-noise ratio SNR, and may be derived as below:

$$R_{PRIO}(k,t)=\frac{P_D(k,t)}{P_N(k,t)}, \quad (8)$$

where $P_{\hat{S}}(k,t)$, $P_N(k,t)$, and $P_D(k,t)$ denote the power of the desired component $\hat{S}(k,t)$, the noise component $\hat{N}(k,t)$, and the subband signal D(k,t), respectively. In an example, the value of the gain function may be bounded in the range from 0 to 1.

It should be noted that the proportions of the desired component and the noise component are not limited to the gain function. Other methods that provide an indication of desired signal and noise classification can be equally applied. The proportions of the desired component and the noise component may also be estimated based on a probability of desired signal (e.g., speech) or noise. An example of the probability-based proportions may be found in Sun, Xuejing/Yen, Kuan-Chieh/Alves, Rogerio (2010): "Robust noise estimation using minimum correction with harmonicity control", In INTERSPEECH-2010, 1085-1088. In this example, the speech absence probability (SAP) q(k, t) may be calculated as below:

$$q(k,t)=\begin{cases}\frac{|D(k,t)|^2}{P_N(k,t-1)}\exp\left(1-\frac{|D(k,t)|^2}{P_N(k,t-1)}\right), & |D(k,t)|^2>P_N(k,t-1)\\ 1, & \text{otherwise}\end{cases}. \quad (9)$$

The proportions of the desired component and the noise component may be estimated as (1−q(k,t)) and q(k,t) respectively. The desired component $\hat{S}(k,t)$ and the noise component $\hat{N}(k,t)$ may be obtained as below:

$$\hat{S}(k,t)=(1-q(k,t))D(k,t) \quad (10),$$

$$\hat{N}(k,t)=q(k,t)D(k,t) \quad (11).$$

The measures of the desired component and the noise component are not limited to their power on the subband. Other measures obtained based on segmentation according to harmonicity (e.g. the harmonicity measure described in Sun, Xuejing/Yen, Kuan-Chieh/Alves, Rogerio (2010): "Robust noise estimation using minimum correction with harmonicity control", In INTERSPEECH-2010, 1085-1088.), spectra or temporal structures may also be used.

Alternatively, to emphasize the desired component, it is also possible to relatively increase the proportion of the desired component or reduce the proportion of the noise component. For example, it is possible to apply an attenuation factor α to the proportion of the noise component, where α≤1. In a further example, 0.5<α≤1.

For each subband signal D(k,t), proportions of the desired component $\hat{S}(k,t)$ and the noise component $\hat{N}(k,t)$ are estimated by the estimator 102. To improve the intelligibility of the mono-channel audio signal, a conventional way is to remove the noise component in the subband signals. However, due to non-stationarity of noise and estimation errors, and the general requirement of actually removing undesired signal to isolate the desired signal, conventional approaches suffer various processing artifacts, such as distortion and musical noise. Because of removing the undesired signal, the estimation of the proportions such as the gain function and the probability of the desired signal and the undesired signal can lead to a destruction or removal of some important information, or the preservation of undesired information in the audio rendering.

When listening with two ears, the human auditory system uses several cues for sound source localization, mainly including interaural time difference (ITD) and interaural level difference (ILD). By performing sound localization, the human auditory system is able to extract the sound of a desired source out of interfering noise. Based on this observation, it is possible to assign a specific spatial hearing property (e.g., sounded as originating from a specific sound source location) to the desired signal by using the cues for sound source localization. The assignment of the spatial hearing property may be achieved through a multi-dimensional auditory presentation method, including but not limited to a binaural auditory presentation method, a method based on a plurality of speakers, and an ambisonics auditory presentation method. Accordingly, it is possible to assign a spatial hearing property, different from that assigned to the desired signal (e.g., sounded as originating from a different sound source location), to the noise signal by using the cues for sound source localization.

In general, the sound source location is determined by an azimuth, an elevation and a distance of the sound source relative to the human auditory system. Depending on specific multi-dimensional auditory presentation methods, the sound source location is assigned by setting at least one of the azimuth, the elevation and the distance. Accordingly, the difference between the different spatial hearing properties comprises at least one of a difference between the azimuths, a difference between the elevations and a difference between the distances.

Alternatively, it is also possible to assign another kind of perceptual hearing properties which facilitate reducing the perceptual attention to the noise signal. For example, the perceptual hearing properties may be those achieved by temporal whitening or frequency whitening (also called as temporal or frequency whitening properties), such as a reflection property, a reverberation property, and a diffusivity property. Such an approach will generally aim to render the desired signal as a focused spatial sound source, whilst the noise signal is perceptually thus aiding the segmentation and intelligibility of the desired signal by the listener.

The generator 103 is configured to generate subband signals M(k,l,t) conesponding respectively to a number L of channels from each subband signal D(k,t), where l is the channel index. The configurations of the channels depend on the requirement of the multi-dimensional auditory presentation method to be adopted to assign the spatial hearing property. Each subband signal M(k,l,t) may include a component $S_M(k,l,t)$ obtained by assigning a spatial hearing property to the desired component $\hat{S}(k,t)$ in the conesponding subband signal D(k,t), and a component $S_N(k,l,t)$ obtained by assigning a perceptual hearing property different from the spatial hearing property to the noise component $\hat{N}(k,t)$ in the conesponding subband signal D(k,t).

The frequency-to-time transformer 104 is configured to transform the subband signals M(k,l,t) into the signal S(t) for rendering with the multi-dimensional auditory presentation method.

By assigning a spatial hearting property and a different perceptual hearing property to the desired signal and the noise signal, the desired signal and the noise signal can be assigned different virtual locations or perceptual features. This permits the use of perceptual separation to increase the perceptual isolation and thus the intelligibility or understanding of the desired signal, without deleting or extracting signal components from the overall signal energy, thus creating less unnatural distortions.

Figure 2:
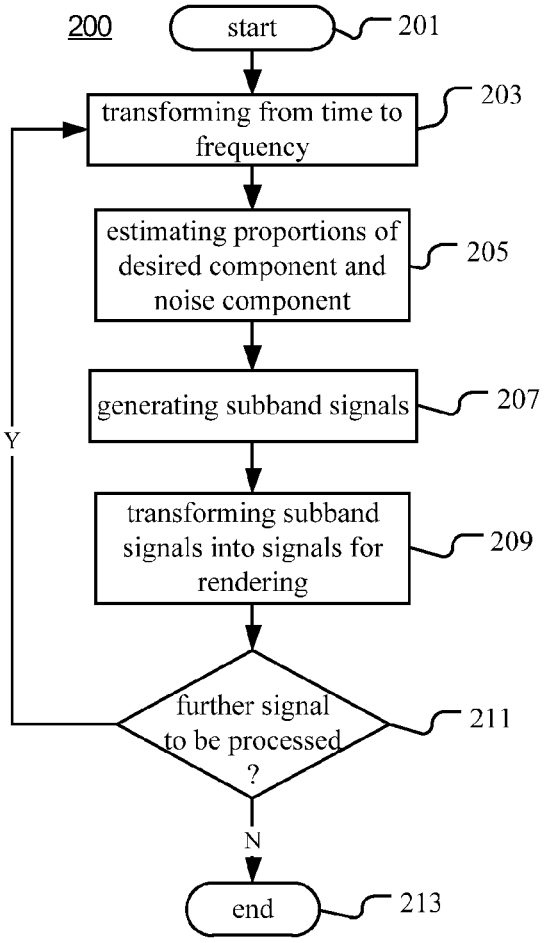
FIG. 2 is a flow chart illustrating an example audio processing method according to an embodiment of the invention.

FIG. 2 is a flow chart illustrating an example audio processing method 200 according to an embodiment of the invention.

As illustrated in FIG. 2, the method 200 starts from step 201. At step 203, a mono-channel audio signal s(t) is transformed into a number K of subband signals (corresponding to K frequency bins) D(k,t), where k is the frequency bin index. For example, the transformation may be performed through a fast-Fourier Transform (FFT).

At step 205, proportions of a desired component and a noise component in the subband signal D(k,t) is estimated. Methods of estimating described in connection with the estimator 102 may be adopted at step 205 to estimate the proportions of the desired component and the noise component in the subband signal D(k,t).

At step 207, subband signals M(k,l,t) conesponding respectively to a number L of channels are generated from the subband signal D(k,t), where l is the channel index. The subband signal M(k,l,t) may include a component $S_M(k,l,t)$ obtained by assigning a spatial hearing property to the desired component $\hat{S}(k,t)$ in the conesponding subband signal D(k,t), and a component $S_N(k,l,t)$ obtained by assigning a perceptual hearing property different from the spatial hearing property to the noise component $\hat{N}(k,t)$ in the corresponding subband signal D(k,t), based on a multi-dimensional auditory presentation method. The configurations of the channels depend on the requirement of the multi-dimensional auditory presentation method to be adopted to assign the spatial hearing property. Methods of generating the subband signals M(k,l,t) described in connection with the generator 103 may be adopted at step 207.

At step 209, the subband signals M(k,l,t) are transformed into the signal S(t) for rendering with the multi-dimensional auditory presentation method.

At step 211, it is determined whether there is another mono-channel audio signal s(t+1) to be processed. If yes, the method 200 returns to step 203 to process the mono-channel audio signal s(t+1). If no, the method 200 ends at step 213.

Figure 3:
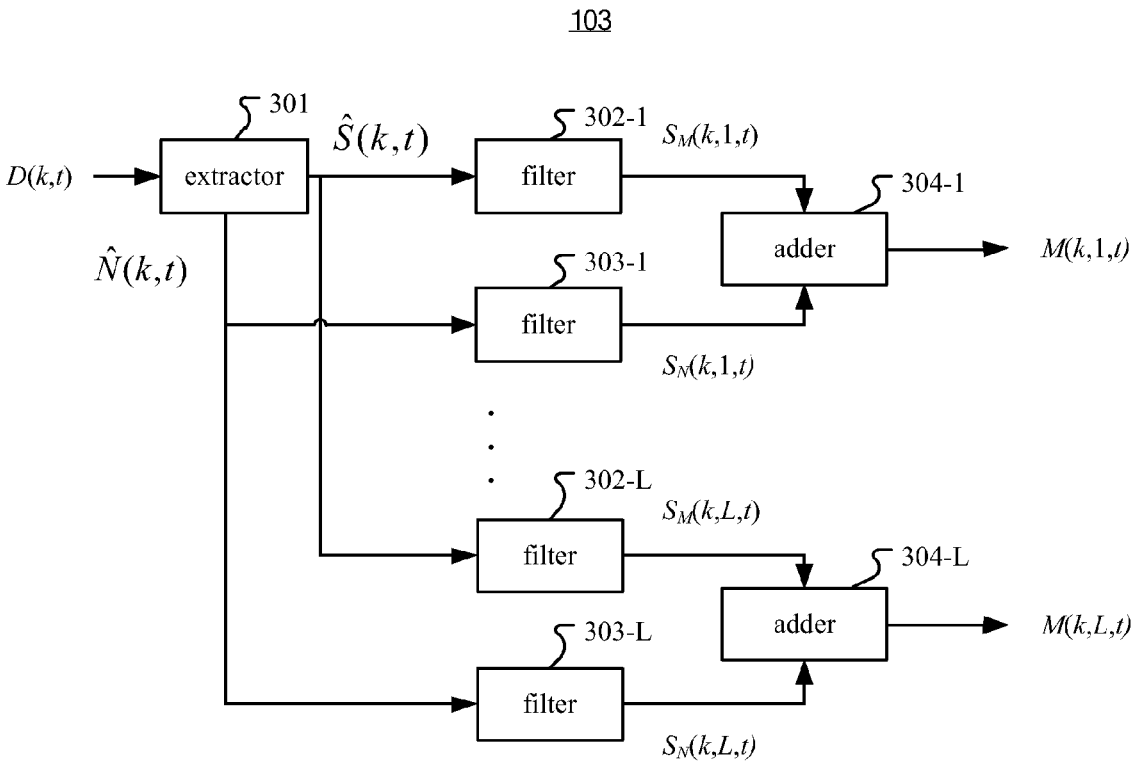
FIG. 3 is a block diagram illustrating an example structure of a generator according to an embodiment of the invention.

FIG. 3 is a block diagram illustrating an example structure of the generator 103 according to an embodiment of the invention.

As illustrated in FIG. 3, the generator 103 includes an extractor 301, filters 302-1 to 302-L, filters 303-1 to 303-L, and adders 304-1 to 304-L.

The extractor 301 is configured to extract the desired component $\hat{S}(k,t)$ and the noise component $\hat{N}(k,t)$ from each subband signal D(k,t) based on the proportions estimated by the estimator 102 respectively. In general, it is possible to extract the desired component $\hat{S}$ (k,t) and the noise component $\hat{N}(k,t)$ by applying the conesponding proportions to the subband signal D(k,t). Equations (1) and (2), as well as Equations (10) and (11) are examples of such an extraction method.

The filters 302-1 to 302-L correspond to the L channels respectively. Each filter **302-*l*** is configured to filter the extracted desired component $\hat{S}(k,t)$ for each subband signal D(k,t) by applying a transfer function $H_{S,l}(k,t)$ for assigning the spatial hearing property, and thus generate a filtered desired component $S_M(k,l,t)=\hat{S}(k,t)H_{S,l}(k,t)$.

The filters 303-1 to 303-L correspond to the L channels respectively. Each filter **303-*l*** is configured to filter the extracted noise component $\hat{N}$(k t) for each subband signal D(k,t) by applying a transfer function $H_{N,l}(k,t)$ for assigning the perceptual hearing property, and thus generate a filtered noise component $S_N(k,l,t)=\hat{N}(k,t)\ H_{N,l}(k,t)$.

The adders 304-1 to 304-L correspond to the L channels respectively. Each adder **304-*l*** is configured to sum the filtered desired component $S_M(k,l,t)$ and the filtered noise component $S_N(k,l,t)$ for each subband signal D(k,t) to obtain a subband signal $M(k,l,t)=\hat{S}(k,t)H_{S,l}(k,t)+\hat{N}(k,t)\ H_{N,l}(k,t)$.

Figure 4:
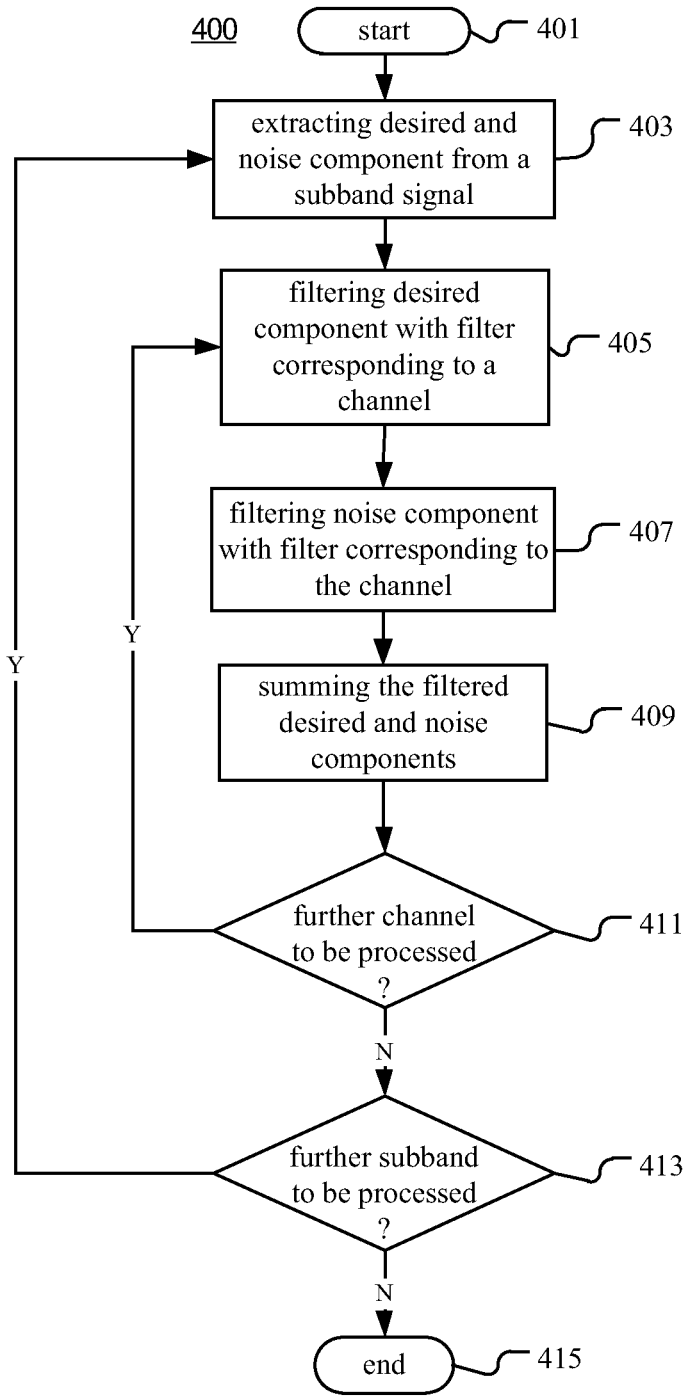
FIG. 4 is a flow chart illustrating an example process of generating subband signals based on the multi-channel auditory presentation method according to an embodiment of the invention.

FIG. 4 is a flow chart illustrating an example process 400 of generating subband signals based on the multi-channel auditory presentation method according to an embodiment of the invention, which may be a specific example of step 207 in the method 200.

As illustrated in FIG. 4, the process 400 starts from step 401. At step 403, the desired component $\hat{S}(k,t)$ and the noise component $\hat{N}(k,t)$ are extracted from a subband signal D(k,t) based on the estimated proportions respectively. In general, it is possible to extract the desired component $\hat{S}(k,t)$ and the noise component $\hat{N}(k,t)$ by applying the corresponding proportions to the subband signal D(k,t). Equations (1) and (2), as well as Equations (10) and (11) are examples of such an extraction method.

At step 405, the extracted desired component $\hat{S}(k,t)$ for the subband signal D(k,t) is filtered by applying a transfer function $H_{S,l}(k,t)$ for assigning the spatial hearing property, thus generating a filtered desired component $S_M(k,l,t)=\hat{S}(k,t)H_{S,l}(k,t)$.

At step 407, the extracted noise component $\hat{N}(k,t)$ for the subband signal D(k,t) is filtered by applying a transfer function $H_{N,l}(k,t)$ for assigning the perceptual hearing property, thus generating a filtered noise component $S_N(k,l,t)=\hat{N}(k,t)H_{N,l}(k,t)$.

At step 409, the filtered desired component $S_M(k,l,t)$ and the filtered noise component $S_N(k,l,t)$ for the subband signal D(k,t) are summed up to obtain a subband signal $M(k,l,t)=\hat{S}(k,t)H_{S,l}(k,t)+\hat{N}(k,t)H_{N,l}(k,t)$.

At step 411, it is determined whether there is another channel l' to be processed. If yes, the process 400 returns to step 405 to generate another subband signal M(k,l',t). If no, the process 400 goes to step 413.

At step 413, it is determined whether there is another subband signal D(k',t) to be processed. If yes, the process 400 returns to step 403 to process the subband signal D(k',t). If no, the process 400 ends at step 415.

In further embodiments of the generator and the process described in connection with FIG. 3 and FIG. 4, the multi-dimensional auditory presentation method is a binaural auditory presentation method. In this case, there are two channels, one for left ear and one for right ear. The transfer function $H_{S,1}(k,t)$ is a head-related transfer function (HRTF) for one of left ear and right ear, and the transfer function $H_{S,2}(k,t)$ is a HRTF for another of left ear and right ear. In general, by applying the HRTFs, the desired sound may be assigned a specific sound location (azimuth $\phi$, elevation $\theta$, distance d) in the rendering. Alternatively, the sound location may be specified by only one or two items of azimuth $\phi$, elevation $\theta$, and distance d. Alternatively, it is possible to divide the desired component into at least two portions, and provide each portion with a set of two HRTFs for assigning a different sound location. The proportions of the divided portions in the desired component may be constant, or adaptive both in time and frequency. It is also possible to separate the desired component into portions corresponding to different sound sources by using a mono-channel source separation technique, and provide each portion with a set of two HRTFs for assigning a different sound location. The difference between the different sound locations may be a difference in azimuth, a difference in elevation, a difference in distance, or a combination thereof. In case of the difference in azimuth, it is preferable that the difference between two azimuths is greater than a minimum threshold. This is because the human auditory system has limited localization resolution. In addition, psychoacoustics studies show that human sound localization precision is highly dependent on source location, which is approximately 1 degree in front of a listener and reduces to less than 10 degree at the sides and rear on the horizontal plane. Therefore, the minimum threshold for the difference between two azimuths may be at least 1 degree.

In the binaural auditory presentation method, it is also possible to assign the perceptual hearing property to the noise component.

Figure 5:
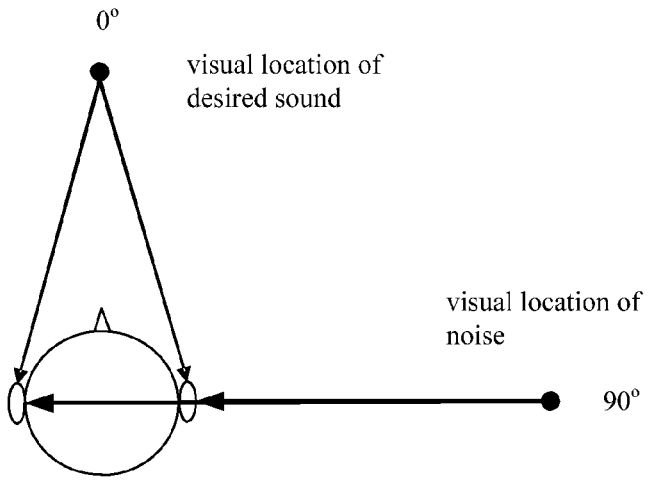
FIG. 5 is a schematic view illustrating an example of sound location arrangement for desired sound and a noise according to an embodiment of the invention.

If the perceptual hearing property is a spatial hearing property different from that assigned to the desired component, in an example, there are two channels, one for left ear and one for right ear. The transfer function $H_{N,1}(k,t)$ is a head-related transfer function (HRTF) for one of left ear and right ear, and the transfer function $H_{N,2}(k,t)$ is a HRTF for another of left ear and right ear. HRTFs $H_{N,l}(k,t)$ and $H_{N,2}(k,t)$ can assign a sound location different from that assigned to the desired component, to the noise component. In an example, the desired component may be assigned with a sound location having an azimuth of 0 degree, and the noise component may be assigned with a sound location having an azimuth of 90 degree, with the listener as an observer. Such an arrangement is illustrated in FIG. 5.

Alternatively, it is possible to divide the noise component into at least two portions, and provide each portion with a set of two HRTFs for assigning a different sound location. The proportions of the divided portions in the noise component may be constant, or adaptive both in time and frequency.

The perceptual hearing property may also be that assigned through temporal or frequency whitening. In case of temporal whitening, the transfer functions $H_{N,l}(k,t)$ are configured to spread the noise component across time to reduce the perceptual significance of the noise signal. In case of frequency whitening, the transfer functions $H_{N,l}(k,t)$ are configured to achieve a spectral whitening of the noise component to reduce the perceptual significance of the noise signal. One example of the frequency whitening is to use the inverse of the long term average spectrum (LTAS) as the transfer functions $H_{N,l}(k,t)$. It should be noted that the transfer functions $H_{N,l}(k,t)$ may be time varying and/or frequency dependent. Various perceptual hearing properties may be achieved through the temporal or frequency whitening, including but not limited to reflection, reverberation, or diffusivity.

In further embodiments of the generator and the process described in connection with FIG. 3 and FIG. 4, the multi-dimensional auditory presentation method is based on two stereo speakers. In this case, there are two channels, i.e., left channel and right channel. In this method, the transfer functions $H_{N,l}(k,t)$ are configured to maintain a low correlation between the transfer functions $H_{N,l'}(k,t)$, so as to reduce the perceptual significance of the noise signal in the rendering. For example, the low correlation can be achieved by adding a 90 degree phase shift between the transfer functions $H_{N,l}(k,t)$ as below:

$$H_{N,1}(k,t)=j \tag{12},$$

$$H_{N,2}(k,t)=-j \tag{13},$$

where j represents the imaginary unit. Because the speakers are placed away from the listener and the noise is of low perceptual significance, the physical position of the speakers can inherently assign a sound location to the rendered desired sound, the transfer functions $H_{S,l}(k,t)$ may be degraded to a constant such as 1.

Alternatively, it is also possible to add additional temporal or frequency whitening property to the transfer functions $H_{N,l}(k,t)$ as below:

$$H_{N,1}(k,t)=j+H_{W,1}(k) \tag{14},$$

$$H_{N,2}(k,t)=-(j+H_{W,2}(k)) \tag{15},$$

where $H_{W,l}(k)$ is configured to assign the temporal or frequency whitening property such as reflection, diffusivity or reverberation to the noise component in the corresponding channel. In an example of a 5-channel system—Left, Centre, Right, Left Surround, Right Surround, there are five transfer functions $H_{S,L}(k,t)$, $H_{S,C}(k,t)$, $H_{S,R}(k,t)$, $H_{S,LS}(k,t)$ and $H_{S,RS}(k,t)$ corresponding to Left, Centre, Right, Left Surround and Right Surround channels respectively, for assigning the spatial hearing property to the desired component, and five transfer functions $H_{N,L}(k,t)$, $H_{N,C}(k,t)$, $H_{N,R}(k,t)$, $H_{N,LS}(k,t)$ and $H_{N,RS}(k,t)$ corresponding to Left, Centre, Right, Left Surround and Right Surround channels respectively, for assigning the perceptual hearing property to the noise component. An example configuration of the transfer functions is as below:

$H_{S,L}(k,t)=0$, $H_{N,L}(k,t)=0$, $H_{S,C}(k,t)$=proportion of the desired component, $H_{N,C}(k,t)=0$, $H_{S,R}(k,t)=0$, $H_{N,R}(k,t)=0$, $H_{S,LS}(k,t)=0$, $H_{N,LS}(k,t)$=reduced proportion of the noise component+$H_{LS}(k)$, $H_{S,RS}(k,t)=0$, $H_{N,RS}(k,t)$=reduced proportion of the noise component+$H_{RS}(k)$.

There is a low correlation between the surround transfer functions $H_{LS}(k)$ and $H_{RS}(k)$, and therefore, a low correlation between $H_{N,LS}(k,t)$ and $H_{N,RS}(k,t)$. It should be apparent from this that other arrangements of the desired signal and the noise signal are also possible. For example, the Left and Right channels may be used rather than the Centre channel for the desired signal, or the noise signal may be distributed across more of the channels with low correlations therebetween.

In further embodiments of the generator and the process described in connection with FIG. 3 and FIG. 4, the multi-dimensional auditory presentation method is an ambisonics auditory presentation method. In the ambisonics auditory presentation method, there are generally four channels, i.e., W, X, Y and Z channels in a B-format. The W channel contains omnidirectional sound pressure information, while the remaining three channels, X, Y and Z, represent sound velocity information measured over the three axes in a 3D Cartesian coordinates.

In this case, there are generally four channels. The transfer functions for assigning the spatial hearing property include $H_{S,W}(k,t)$=a constant such as 1 or $\sqrt{2}/2$, $H_{S,X}(k,t)=\cos(\phi)\cos(\theta)$, $H_{S,Y}(k,t)=\sin(\phi)\cos(\theta)$ and $H_{S,Z}(k,t)=\sin(\theta)$ corresponding to W, X, Y and Z channels respectively. By applying these transfer functions to the extracted desired component $\hat{S}(k,t)$, the desired sound may be assigned a specific sound location (azimuth $\phi$, elevation $\theta$) in the rendering. Alternatively, the sound location may be specified by only one item of azimuth $\phi$ and elevation $\theta$. For example, it is possible to assume the elevation $\theta=0$. In this case, there can be three channels W, X and Y, corresponding to a first order horizontal sound field representation. It should be noted that the embodiment is also applicable to a 3D (WXYZ) or higher order planar or 3D sound field representation. The transfer functions for assigning the perceptual hearing property include $H_{N,W}(k,t)$, $H_{N,X}(k,t)$, $H_{N,Y}(k,t)$ and $H_{N,Z}(k,t)$ corrresponding to W, X, Y and Z channels respectively. $H_{N,W}(k,t)$, $H_{N,X}(k,t)$, $H_{N,Y}(k,t)$ and $H_{N,Z}(k,t)$ may apply a temporal or frequency whitening for reduce the perceptual significance of the noise signal, or a spatial hearing property different from that assigned to the desired component.

Figure 6:
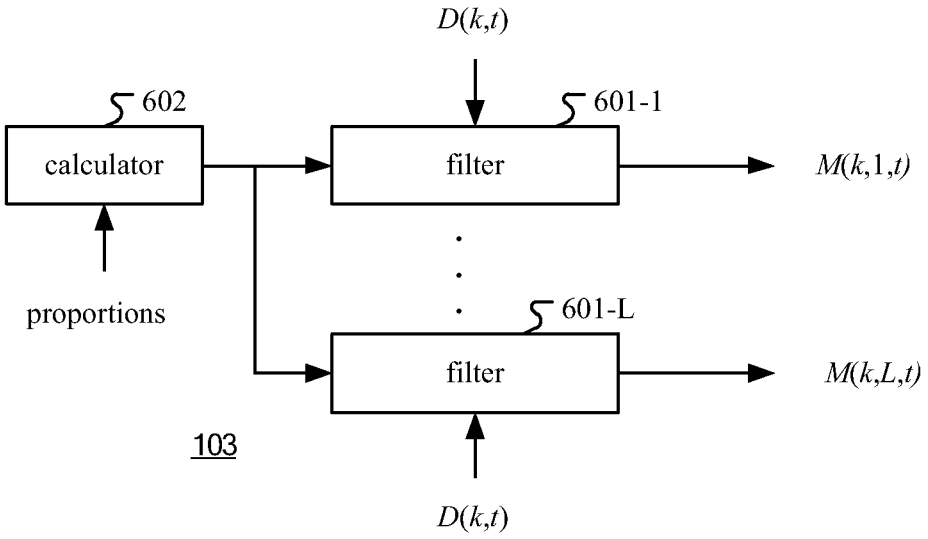
FIG. 6 is a block diagram illustrating an example structure of a generator according to an embodiment of the invention.

FIG. 6 is a block diagram illustrating an example structure of the generator 103 according to an embodiment of the invention.

As illustrated in FIG. 6, the generator 103 includes a calculator 602 and filters 601-1 to 601-L corresponding to the L channels respectively.

For each channel l and each subband signal D(k,t), the calculator 602 is configured to calculate a filter parameter H(k,l,t). Each filter parameter H(k,l,t) is a weighted sum of a transfer function $H_{S,l}(k,t)$ for assigning the spatial hearing property and another transfer function $H_{N,l}(k,t)$ for assigning the perceptual hearing property. The weight $W_S$ for the transfer function $H_{S,l}(k,t)$ and the weight $W_N$ for the other transfer function $H_{N,l}(k,t)$ are in positive correlation to the proportions of the desired component and the noise component in the corresponding subband signal D(k,t). Namely, each filter parameter H(k,l,t) may be denoted as below:

$$H(k,l,t)=W_S H_{S,l}(k,t)+W_N H_{N,l}(k,t).$$

In an example, the weight $W_S$ and the weight $W_N$ may be the proportions of the desired component and the noise component respectively.

For each subband signal D(k,t), each filter 601-*l* is configured to apply the filter parameter H(k,l,t) to the subband signal D(k,t) to obtain a subband signal M(k,l,t)=D(k,t)H(k,l,t).

Figure 7:
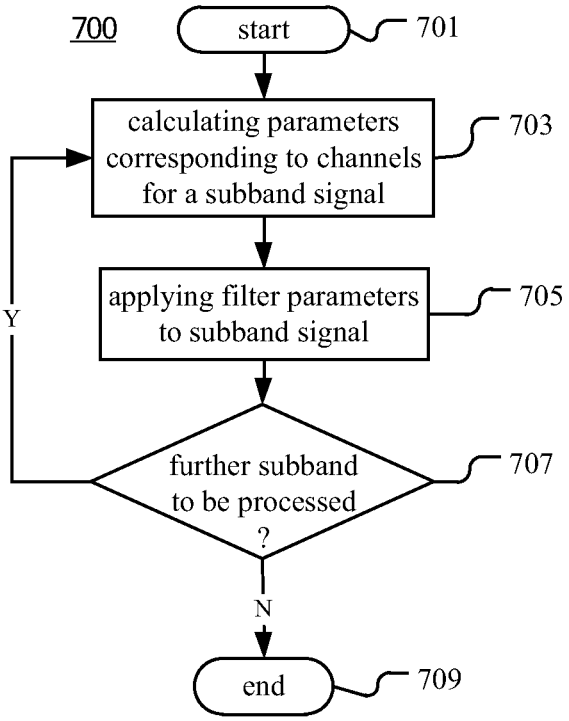
FIG. 7 is a flow chart illustrating an example process of generating subband signals based on the multi-channel auditory presentation method according to an embodiment of the invention.

FIG. 7 is a flow chart illustrating an example process 700 of generating subband signals based on the multi-channel auditory presentation method according to an embodiment of the invention.

As illustrated in FIG. 7, the process 700 starts from step 701. At step 703, filter parameters H(k,l,t) corresponding to the L channels are calculated for a subband signal D(k,t), where l is the channel index. Each filter parameter H(k,l,t) is a weighted sum of a transfer function $H_{S,l}(k,t)$ for assigning the spatial hearing property and another transfer function $H_{N,l}(k,t)$ for assigning the perceptual hearing property. The weight $W_S$ for the transfer function $H_{S,l}(k,t)$ and the weight $W_N$ for the other transfer function $H_{N,l}(k,t)$ are in positive correlation to the proportions of the desired component and the noise component in the corresponding subband signal D(k,t). In an example, the weight $W_S$ and the weight $W_N$ may be the proportions of the desired component and the noise component respectively.

At step 705, each filter parameters H(k,l,t) is applied to the subband signal D(k,t) to obtain a subband signal M(k,l,t)=D(k,t)H(k,l,t).

At step 707, it is determined whether there is another subband signal D(k',t) to be processed. If yes, the process 700 returns to step 703 to process the subband signal D(k',t). If no, the process 700 ends at step 709.

According to the embodiments described in connection with FIG. 6 and FIG. 7, it is not required to extract the desired component and the noise component, and the spatial hearing property and the perceptual hearing property can be assigned by directly applying the filter parameters to the subband signals. This permits a simpler structure and process, and avoids the errors which may be introduced due to extraction and separate filtering.

In further embodiments of the generator and the process described in connection with FIG. 6 and FIG. 7, the multi-dimensional auditory presentation method is a binaural auditory presentation method. In this case, there are two channels, one for left ear and one for right ear. The transfer function $H_{S,1}(k,t)$ is a head-related transfer function (HRTF) for one of left ear and right ear, and the transfer function $H_{S,2}(k,t)$ is a HRTF for another of left ear and right ear. In general, by applying the HRTFs, the desired sound may be assigned a specific sound location (azimuth $\phi$, elevation $\theta$, distance d) in the rendering. Alternatively, the sound location may be specified by only one or two items of azimuth $\phi$, elevation $\theta$, and distance d. Alternatively, it is possible to divide the desired component into at least two portions, and provide each portion with a set of two HRTFs for assigning a different sound location. The proportions of the divided portions in the desired component may be constant, or adaptive both in time and frequency. It is also possible to separate the desired component into portions corresponding to different sound sources by using a mono-channel source separation technique, and provide each portion with a set of two HRTFs for assigning a different sound location. The difference between the different sound locations may be a difference in azimuth, a difference in elevation, a difference in distance, or a combination thereof.

In the binaural auditory presentation method, it is also possible to assign the perceptual hearing property to the noise component.

If the perceptual hearing property is a spatial hearing property different from that assigned to the desired component, in an example, there are two channels, one for left ear and one for right ear. The transfer function $H_{N,1}(k,t)$ is a head-related transfer function (HRTF) for one of left ear and right ear, and the transfer function $H_{N,2}(k,t)$ is a HRTF for another of left ear and right ear. HRTFs $H_{N,1}(k,t)$ and $H_{N,2}(k,t)$ can assign a sound location different from that assigned to the desired component, to the noise component. In an example, the desired component may be assigned with a sound location having an azimuth of 0 degree, and the noise component may be assigned with a sound location having an azimuth of 90 degree, with the listener as an observer.

Alternatively, it is possible to divide the noise component into at least two portions, and provide each portion with a set of two HRTFs for assigning a different sound location. The proportions of the divided portions in the noise component may be constant, or adaptive both in time and frequency.

The perceptual hearing property may also be that assigned through temporal or frequency whitening. In case of temporal whitening, the transfer functions $H_{N,l}(k,t)$ are configured to spread the noise component across time to reduce the perceptual significance of the noise signal. In case of frequency whitening, the transfer functions $H_{N,l}(k,t)$ are configured to achieve a spectral whitening of the noise component to reduce the perceptual significance of the noise signal. One example of the frequency whitening is to use the inverse of the long term average spectrum (LTAS) as the transfer functions $H_{N,l}(k,t)$. It should be noted that the transfer functions $H_{N,l}(k,t)$ may be time varying and/or frequency dependent. Various perceptual hearing properties may be achieved through the temporal or frequency whitening, including but not limited to reflection, reverberation, or diffusivity.

In further embodiments of the generator and the process described in connection with FIG. 6 and FIG. 7, the multi-dimensional auditory presentation method is based on two stereo speakers. In this case, there are two channels, i.e., left channel and right channel. In this method, the transfer functions $H_{N,l}(k,t)$ are configured to maintain a low correlation between the transfer functions $H_{N,l}(k,t)$, so as to reduce the perceptual significance of the noise signal in the rendering. For example, the low correlation can be achieved by adding a 90 degree phase shift between the transfer functions $H_{N,l}(k,t)$ as in Equations (12) and (13). Because the speakers are placed away from the listener and the noise is of low perceptual significance, the physical position of the speakers can inherently assign a sound location to the rendered desired sound, the transfer functions $H_{S,l}(k,t)$ may be degraded to a constant such as 1.

Alternatively, it is also possible to add additional temporal or frequency whitening property to the transfer functions $H_{N,l}(k,t)$ as in Equations (14) and (15).

In an example of a 5-channel system—Left, Centre, Right, Left Surround, Right Surround, there are five transfer functions $H_{S,L}(k,t)$, $H_{S,C}(k,t)$, $H_{S,R}(k,t)$, $H_{S,LS}(k,t)$ and $H_{S,RS}(k,t)$ corresponding to Left, Centre, Right, Left Surround and Right Surround channels respectively, for assigning the spatial hearing property to the desired component, and five transfer functions $H_{N,L}(k,t)$, $H_{N,C}(k,t)$, $H_{N,R}(k,t)$, $H_{N,LS}(k,t)$ and $H_{N,RS}(k,t)$ corresponding to Left, Centre, Right, Left Surround and Right Surround channels respectively, for assigning the perceptual hearing property to the noise component. An example configuration of the transfer functions is as below:

$H_{S,L}(k,t)=0$, $H_{N,L}(k,t)=0$, $H_{S,C}(k,t)$=proportion of the desired component, $H_{N,C}(k,t)=0$, $H_{S,R}(k,t)=0$, $H_{N,R}(k,t)=0$, $H_{S,LS}(k,t)=0$, $H_{N,LS}(k,t)$=reduced proportion of the noise component+$H_{LS}(k)$, $H_{S,RS}(k,t)=0$, $H_{N,RS}(k,t)$=reduced proportion of the noise component+$H_{RS}(k)$.

There are a low correlation between the surround transfer functions $H_{LS}(k)$ and $H_{RS}(k)$, and therefore, a low correlation between $H_{N,LS}(k,t)$ and $H_{N,RS}(k,t)$. It should be apparent from this that other arrangements of the desired signal and the noise signal are also possible. For example, the Left and Right channels may be used rather than the Centre channel for the desired signal, or the noise signal may be distributed across more of the channels with low correlations therebetween.

In further embodiments of the generator and the process described in connection with FIG. 6 and FIG. 7, the multi-dimensional auditory presentation method is an ambisonics auditory presentation method. In the ambisonics auditory presentation method, there are generally four channels, i.e., W, X, Y and Z channels in a B-format. The W channel contains omnidirectional sound pressure information, while the remaining three channels, X, Y and Z, represent sound velocity information measured over the three axes in a 3D Cartesian coordinates.

In this case, there are generally four channels. The transfer functions for assigning the spatial hearing property include $H_{S,W}(k,t)$=a constant such as 1 or $\sqrt{2}/2$, $H_{S,X}(k,t)=\cos(\phi)\cos(\theta)$, $H_{S,Y}(k,t)=\sin(\phi)\cos(\theta)$ and $H_{S,Z}(k,t)=\sin(\theta)$ corresponding to W, X, Y and Z channels respectively. By applying these transfer functions, the desired sound may be assigned a specific sound location (azimuth $\phi$, elevation $\theta$) in the rendering. Alternatively, the sound location may be specified by only one item of azimuth $\phi$ and elevation $\theta$. For example, it is possible to assume the elevation $\theta=0$. In this case, there can be three channels W, X and Y, corresponding to a first order horizontal sound field representation. It should be noted that the embodiment is also applicable to a 3D (WXYZ) or higher order planar or 3D sound field representation. The transfer functions for assigning the perceptual hearing property include $H_{N,W}(k,t)$, $H_{N,X}(k,t)$, $H_{N,Y}(k,t)$ and $H_{N,Z}(k,t)$ corresponding to W, X, Y and Z channels respectively. $H_{N,W}(k,t)$, $H_{N,X}(k,t)$, $H_{N,Y}(k,t)$ and $H_{N,Z}(k,t)$ may apply a temporal or frequency whitening for reduce the perceptual significance of the noise signal, or a spatial hearing property different from that assigned to the desired component.

Figure 8:
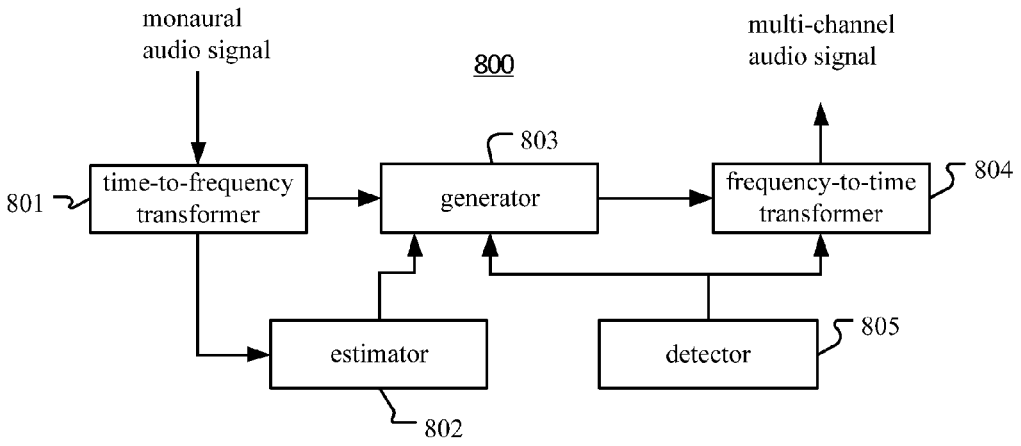
FIG. 8 is a block diagram illustrating an example audio processing apparatus according to an embodiment of the invention.

FIG. 8 is a block diagram illustrating an example audio processing apparatus 800 according to an embodiment of the invention.

As illustrated in FIG. 8, the audio processing apparatus 800 includes a time-to-frequency transformer 801, an estimator 802, a generator 803, a frequency-to-time transformer 804 and a detector 805. The time-to-frequency transformer 801 and the estimator 802 have the same structures and functions with the time-to-frequency transformer 101 and the estimator 102 respectively, and will not be described in detail herein.

Figure 9:
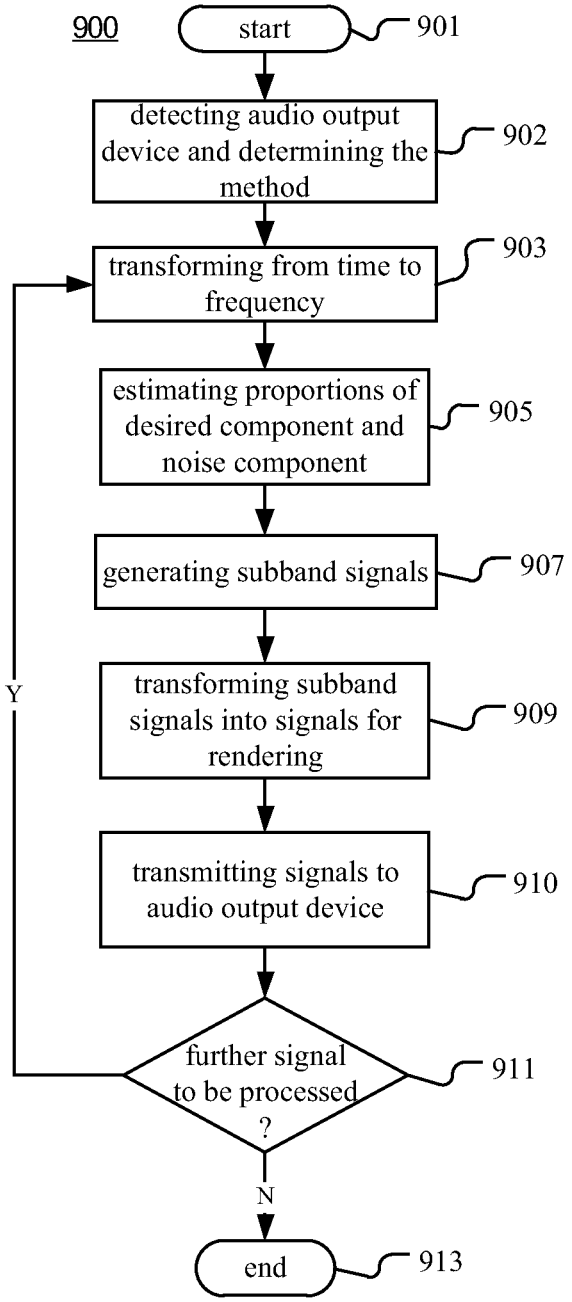
FIG. 9 is a flow chart illustrating an example audio processing method according to an embodiment of the invention.

The detector 805 is configured to detect an audio output device which is activated presently for audio rendering, and determine the multi-dimensional auditory presentation method adopted by the audio output device. The apparatus 800 may be able to be coupled with at least two audio output devices which can support the audio rendering based on different multi-dimensional auditory presentation methods. For example, the audio output devices may include a head phone supporting a binaural auditory presentation method and a speaker system supporting an ambisonics auditory presentation method. A user may operate the apparatus 800 to switch between the audio output devices for audio rendering. In this case, the detector 805 is used to determine the multi-dimensional auditory presentation method presently being used. Upon the detector 805 determines the multi-dimensional auditory presentation method, the generator 803 and the frequency-to-time transformer 804 operate based on the determined multi-dimensional auditory presentation method. In case that the multi-dimensional auditory presentation method is determined, the generator 803 and the frequency-to-time transformer 804 perform the same functions with the generator 103 and the frequency-to-time transformer 104 respectively. The frequency-to-time transformer 804 is further configured to transmit the signals for rendering to the detected audio output device. FIG. 9 is a flow chart illustrating an example audio processing method 900 according to an embodiment of the invention. In the method 900, steps 903, 905 and 911 have the same functions as steps 203, 205 and 211 respectively, and will not be described in detail herein.

As illustrated in FIG. 9, the method 900 starts from step 901. At step 902, an audio output device which is activated presently for audio rendering is detected, and the multi-dimensional auditory presentation method adopted by the audio output device is determined. At least two audio output devices which can support the audio rendering based on different multi-dimensional auditory presentation methods may be coupled to an audio processing apparatus. For example, the audio output devices may include a head phone supporting a binaural auditory presentation method and a speaker system supporting an ambisonics auditory presentation method. A user may operate to switch between the audio output devices for audio rendering. In this case, by performing step 902, it is possible to determine the multi-dimensional auditory presentation method presently being used. Upon determining the multi-dimensional auditory presentation method, steps 907 and 909 are performed based on the determined multi-dimensional auditory presentation method. In case that the multi-dimensional auditory presentation method is determined, steps 907 and 909 perform the same functions as steps 207 and 209 respectively. After step 909, the signals for rendering are transmitted to the detected audio output device at step 910. The method 900 ends at step 913.

By assigning different perceptual hearing properties to different components, there may be spectral gaps in the signals for rendering. This may create perceptual problems, particularly when a single intermediate channel can be heard in isolation.

In further embodiments of the apparatuses and the methods described in the above, it is possible to perform a control in estimating the proportions so that the proportions of the desired component and the noise component do not fall below the corresponding lower limits. For example, generally, especially in case of the binaural auditory presentation method, the proportions of the desired component and the noise component in each subband signal D(k,t) are respectively estimated as not greater than 0.9 and not smaller than 0.1. By doing this, in an example of voice communication, it is possible to achieve about 20 dB maximum noise suppression on voice channel and about −20 dB min of residual desired signal in the noise channel. Also, in case that the multi-dimensional auditory presentation method is based on multiple speakers, such as the aforementioned 5-channel system, the proportion of the desired component in each subband signal D(k,t) is estimated as not greater than 0.7, and the proportion of the noise component in each subband signal D(k,t) is estimated as not smaller than 0. By doing this, in an example of voice communication, it is possible to achieve about infinitive maximum noise suppression on voice channel and about −10 dB min of residual signal in the noise channel. Consequently, it is helpful to avoid the case where the background channel seems abnormal if it is gated off suddenly and can be heard isolation.

As a further improvement, it is possible to limit the proportions of the desired component and the noise component independently. Alternately, the proportions of the desired component and the noise component can be derived as separate functions from the probability or the simple gain, and therefore have different properties. For example, assuming that the proportion of the desired component is represented as G, the proportion of the noise component is estimated as $\sqrt{1-G^2}$. Accordingly, it is possible to achieve a preservation of energy.

Figure 10:
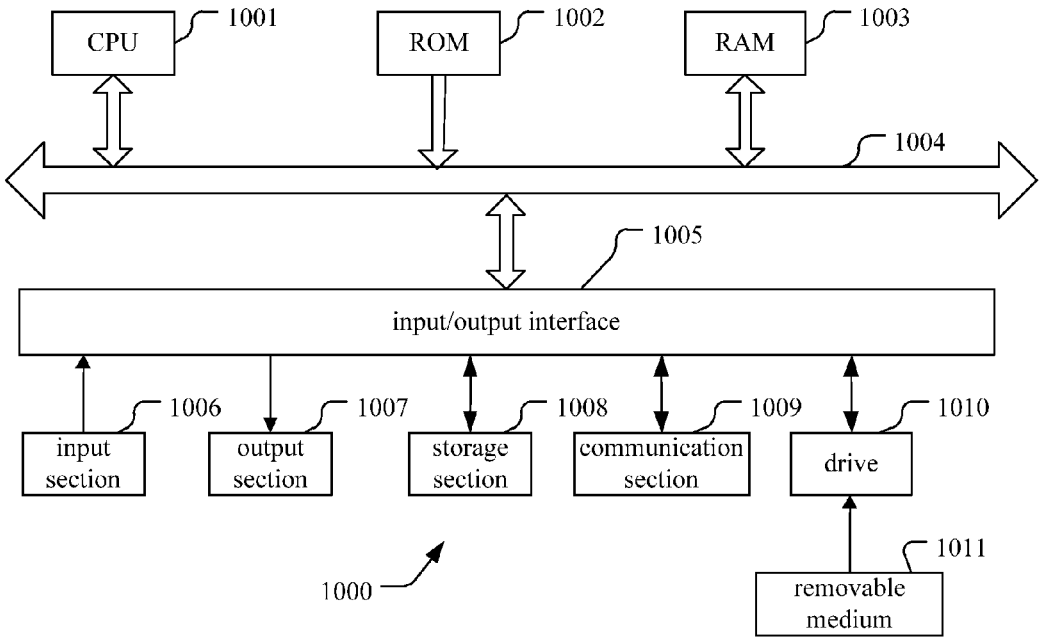
FIG. 10 is a block diagram illustrating an exemplary system for implementing embodiments of the present invention.

FIG. 10 is a block diagram illustrating an exemplary system for implementing the aspects of the present invention.

In FIG. 10, a central processing unit (CPU) 1001 performs various processes in accordance with a program stored in a read only memory (ROM) 1002 or a program loaded from a storage section 1008 to a random access memory (RAM) 1003. In the RAM 1003, data required when the CPU 1001 performs the various processes or the like are also stored as required.

The CPU 1001, the ROM 1002 and the RAM 1003 are connected to one another via a bus 1004. An input/output interface 1005 is also connected to the bus 1004.

The following components are connected to the input/output interface 1005: an input section 1006 including a keyboard, a mouse, or the like; an output section 1007 including a display such as a cathode ray tube (CRT), a liquid crystal display (LCD), or the like, and a loudspeaker or the like; the storage section 1008 including a hard disk or the like; and a communication section 1009 including a network interface card such as a LAN card, a modem, or the like. The communication section 1009 performs a communication process via the network such as the internet.

A drive 1010 is also connected to the input/output interface 1005 as required. A removable medium 1011, such as a magnetic disk, an optical disk, a magneto-optical disk, a semiconductor memory, or the like, is mounted on the drive 1010 as required, so that a computer program read therefrom is installed into the storage section 1008 as required.

In the case where the above-described steps and processes are implemented by the software, the program that constitutes the software is installed from the network such as the internet or the storage medium such as the removable medium 1011.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE 1. An audio processing method comprising:

transforming a mono-channel audio signal into a plurality of first subband signals;

estimating proportions of a desired component and a noise component in each of the subband signals;

generating second subband signals conesponding respectively to a plurality of channels from each of the first subband signals, wherein each of the second subband signals comprises a first component and a second component obtained by assigning a spatial hearing property and a perceptual hearing property different from the spatial hearing property to the desired component and the noise component in the conesponding first subband signal respectively, based on a multi-dimensional auditory presentation method; and transforming the second subband signals into signals for rendering with the multi-dimensional auditory presentation method.

EE 2. The audio processing method according to EE 1, wherein generating second subband signals comprises:

extracting the desired component and the noise component from each of the first subband signals based on the proportions respectively; and for each of the channels and each of the first subband signals, filtering the extracted desired component for the first subband signal with a first filter which corresponds to the channel and applies a first transfer function for assigning the spatial hearing property, filtering the extracted noise component for the first subband signal with a second filter which corresponds to the channel and applies a second transfer function for assigning the perceptual hearing property; and summing the filtered desired component and the filtered noise component to obtain one of the second subband signals.

EE 3. The audio processing method according to EE 1, wherein generating second subband signals comprises:

for each of the channels and each of the first subband signals, calculating a filter parameter, wherein the filter parameter is a weighted sum of a transfer function for assigning the spatial hearing property and another transfer function for assigning the perceptual hearing property, and weights for the transfer function and the other transfer function are in positive correlation to the proportions of the desired component and the noise component in the corresponding first subband signal respectively, for each of the channels and each of the first subband signals, applying the corresponding filter parameter to the first subband signal to obtain one of the second subband signals.

EE 4. The audio processing method according to one of EEs 1 to 3, wherein the perceptual hearing property comprises a spatial hearing property or a temporal or frequency whitening property.

EE 5. The audio processing method according to EE 4, wherein the temporal or frequency whitening property comprises a reflection property, a reverberation property, or a diffusivity property.

EE 6. The audio processing method according to one of EEs 1 to 3, wherein the multi-dimensional auditory presentation method is a binaural auditory presentation method, and wherein each of the first transfer functions comprises one or more head-related transfer functions for assigning different spatial hearing properties.

EE 7. The audio processing method according to EE 6, wherein each of the second transfer functions comprises one or more head-related transfer functions for assigning spatial hearing properties different from the spatial hearing properties assigned by the first transfer functions.

EE 8. The audio processing method according to EE 6 or 7, wherein the difference between the different spatial hearing properties comprises at least one of a difference between their azimuths, a difference between their elevations and a difference between their distance.

EE 9. The audio processing method according to one of EEs 1 to 3, wherein the multi-dimensional auditory presentation method is based on two stereo speakers, and wherein there is a low correlation between the second transfer functions corresponding to the same first subband signal.

EE 10. The audio processing method according to one of EEs 1 to 3, wherein the proportions of the desired component and the noise component in each of the first subband signals are estimated as not greater than 0.9 and not smaller than 0.1 respectively.

EE 11. The audio processing method according to EE 10, wherein assuming that the proportion of the desired component is represented as G, the proportion of the noise component is estimated as $\sqrt{1-G^2}$.

EE 12. The audio processing method according to one of EEs 1 to 3, wherein the proportions of the desired component and the noise component in each of the first subband signals are estimated based on a gain function or a probability.

EE 13. The audio processing method according to one of EEs 1 to 3, wherein the multi-dimensional auditory presentation method is an ambisonics auditory presentation method, and wherein the first transfer functions are adapted to present the same sound source in a sound field.

EE 14. The audio processing method according to one of EEs 1 to 3, wherein the multi-dimensional auditory presentation method is based on multiple speakers, and wherein the proportions of the desired component and the noise component in each of the first subband signals are estimated as not greater than 0.7 and not smaller than 0 respectively.

EE 15. The audio processing method according to one of EEs 1 to 3, further comprising:

detecting an audio output device which is activated presently for audio rendering;

determining the multi-dimensional auditory presentation method adopted by the audio output device; and transmitting the signals for rendering to the audio output device.

EE 16. An audio processing apparatus comprising:

a time-to-frequency transformer configured to transform a mono-channel audio signal into a plurality of first subband signals;

an estimator configured to estimate proportions of a desired component and a noise component in each of the subband signals;

a generator configured to generate second subband signals corresponding respectively to a plurality of channels from each of the first subband signals, wherein each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method; and a frequency-to-time transformer configured to transform the second subband signals into signals for rendering with the multi-dimensional auditory presentation method.

EE 17. The audio processing apparatus according to EE 16, wherein the generator comprises:

an extractor configured to extract the desired component and the noise component from each of the first subband signals based on the proportions respectively;

first filters corresponding to the channels respectively, each of which is configured to filter the extracted desired component for each of the first subband signals by applying a first transfer function for assigning the spatial hearing property, second filters corresponding to the channels respectively, each of which is configured to filter the extracted noise component for each of the first subband signals by applying a second transfer function for assigning the perceptual hearing property; and adders corresponding to the channels respectively, each of which is configured to sum the filtered desired component and the filtered noise component for each of the first subband signals to obtain one of the second subband signals.

EE 18. The audio processing apparatus according to EE 16, wherein the generator comprises:

a calculator configured to, for each of the channels and each of the first subband signals, calculate a filter parameter, wherein the filter parameter is a weighted sum of a transfer function for assigning the spatial hearing property and another transfer function for assigning the perceptual hearing property, and weights for the transfer function and the other transfer function are in positive correlation to the proportions of the desired component and the noise component in the corresponding first subband signal respectively, filters corresponding to the channels respectively, each of which is configured to apply the filter parameter corresponding to the channel and each of the first subband signals to obtain one of the second subband signals.

EE 19. The audio processing apparatus according to one of EEs 16 to 18, wherein the perceptual hearing property comprises a spatial hearing property or a temporal or frequency whitening property.

EE 20. The audio processing apparatus according to EE 19, wherein the temporal or frequency whitening property comprises a reflection property, a reverberation property, or a diffusivity property.

EE 21. The audio processing apparatus according to one of EEs 16 to 18, wherein the multi-dimensional auditory presentation method is a binaural auditory presentation method, and wherein each of the first transfer functions comprises one or more head-related transfer functions for assigning different spatial hearing properties.

EE 22. The audio processing apparatus according to EE 21, wherein each of the second transfer functions comprises one or more head-related transfer functions for assigning spatial hearing properties different from the spatial hearing properties assigned by the first transfer functions.

EE 23. The audio processing apparatus according to EE 21 or 22, wherein the difference between the different spatial hearing properties comprises at least one of a difference between their azimuths, a difference between their elevations and a difference between their distance.

EE 24. The audio processing apparatus according to one of EEs 16 to 18, wherein the multi-dimensional auditory presentation method is based on two stereo speakers, and wherein there is a low correlation between the second transfer functions corresponding to the same first subband signal.

EE 25. The audio processing apparatus according to one of EEs 16 to 18, wherein the proportions of the desired component and the noise component in each of the first subband signals are estimated as not greater than 0.9 and not smaller than 0.1 respectively.

EE 26. The audio processing apparatus according to EE 25, wherein assuming that the proportion of the desired component is represented as G, the proportion of the noise component is estimated as $\sqrt{1-G^2}$.

EE 27. The audio processing apparatus according to one of EEs 16 to 18, wherein the proportions of the desired component and the noise component in each of the first subband signals are estimated based on a gain function or a probability.

EE 28. The audio processing apparatus according to one of EEs 16 to 18, wherein the multi-dimensional auditory presentation method is an ambisonics auditory presentation method, and wherein the first transfer functions are adapted to present the same sound source in a sound field.

EE 29. The audio processing apparatus according to one of EEs 16 to 18, wherein the multi-dimensional auditory presentation method is based on multiple speakers, and wherein the proportions of the desired component and the noise component in each of the first subband signals are estimated as not greater than 0.7 and not smaller than 0 respectively.

EE 30. The audio processing apparatus according to one of EEs 16 to 18, further comprising:

a detector configured to detect an audio output device which is activated presently for audio rendering, and determine the multi-dimensional auditory presentation method adopted by the audio output device, and wherein the frequency-to-time transformer is further configured to transmit the signals for rendering to the audio output device.

EE 31. A computer-readable medium having computer program instructions recorded thereon for enabling a processor to perform audio processing, the computer program instructions comprising:

means for transforming a mono-channel audio signal into a plurality of first subband signals means for estimating proportions of a desired component and a noise component in each of the subband signals;

means for generating second subband signals corresponding respectively to a plurality of channels from each of the first subband signals, wherein each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method; and means for transforming the second subband signals into signals for rendering with the multi-dimensional auditory presentation method.

We claim:

1. An audio processing method comprising:

transforming a mono-channel audio signal into a plurality of first subband signals;

estimating proportions of a desired component and a noise component in each of the subband signals;

generating second subband signals corresponding respectively to a plurality of channels from each of the first subband signals, wherein each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method; and transforming the second subband signals into signals for rendering with the multi-dimensional auditory presentation method.

2. The audio processing method according to claim 1, wherein generating second subband signals comprises:

extracting the desired component and the noise component from each of the first subband signals based on the proportions respectively; and for each of the channels and each of the first subband signals, filtering the extracted desired component for the first subband signal with a first filter which corresponds to the channel and applies a first transfer function for assigning the spatial hearing property, filtering the extracted noise component for the first subband signal with a second filter which corresponds to the channel and applies a second transfer function for assigning the perceptual hearing property; and summing the filtered desired component and the filtered noise component to obtain one of the second subband signals.

3. The audio processing method according to claim 1, wherein generating second subband signals comprises:

for each of the channels and each of the first subband signals, calculating a filter parameter, wherein the filter parameter is a weighted sum of a transfer function for assigning the spatial hearing property and another transfer function for assigning the perceptual hearing property, and weights for the transfer function and the other transfer function are in positive correlation to the proportions of the desired component and the noise component in the corresponding first subband signal respectively, for each of the channels and each of the first subband signals, applying the corresponding filter parameter to the first subband signal to obtain one of the second subband signals.

4. The audio processing method according to claim 1, wherein the perceptual hearing property comprises a spatial hearing property or a temporal or frequency whitening property.

5. The audio processing method according to claim 2, wherein the multi-dimensional auditory presentation method is a binaural auditory presentation method, and wherein each of the first transfer functions comprises one or more head-related transfer functions for assigning different spatial hearing properties.

6. The audio processing method according to claim 2, wherein the multi-dimensional auditory presentation method is based on two stereo speakers, and wherein there is a low correlation between the second transfer functions corresponding to the same first subband signal.

7. The audio processing method according to claim 1, wherein the proportions of the desired component and the noise component in each of the first subband signals are estimated as not greater than 0.9 and not smaller than 0.1 respectively.

8. The audio processing method according to claim 1, wherein the proportions of the desired component and the noise component in each of the first subband signals are estimated based on a gain function or a probability.

9. The audio processing method according to claim 2, wherein the multi-dimensional auditory presentation method is an ambisonics auditory presentation method, and wherein the first transfer functions are adapted to present the same sound source in a sound field.

10. The audio processing method according to claim 1, further comprising:

detecting an audio output device which is activated presently for audio rendering;

determining the multi-dimensional auditory presentation method adopted by the audio output device; and transmitting the signals for rendering to the audio output device.

11. An audio processing apparatus comprising:

a time-to-frequency transformer configured to transform a mono-channel audio signal into a plurality of first subband signals;

an estimator configured to estimate proportions of a desired component and a noise component in each of the subband signals;

a generator configured to generate second subband signals corresponding respectively to a plurality of channels from each of the first subband signals, wherein each of the second subband signals comprises a first component and a second component obtained by assigning a spatial hearing property and a perceptual hearing property different from the spatial hearing property to the desired component and the noise component in the corresponding first subband signal respectively, based on a multi-dimensional auditory presentation method; and a frequency-to-time transformer configured to transform the second subband signals into signals for rendering with the multi-dimensional auditory presentation method.

12. The audio processing apparatus according to claim 11, wherein the generator comprises:

an extractor configured to extract the desired component and the noise component from each of the first subband signals based on the proportions respectively;

first filters corresponding to the channels respectively, each of which is configured to filter the extracted desired component for each of the first subband signals by applying a first transfer function for assigning the spatial hearing property, second filters corresponding to the channels respectively, each of which is configured to filter the extracted noise component for each of the first subband signals by applying a second transfer function for assigning the perceptual hearing property; and adders corresponding to the channels respectively, each of which is configured to sum the filtered desired component and the filtered noise component for each of the first subband signals to obtain one of the second subband signals.

13. The audio processing apparatus according to claim 11, wherein the generator comprises:

a calculator configured to, for each of the channels and each of the first subband signals, calculate a filter parameter, wherein the filter parameter is a weighted sum of a transfer function for assigning the spatial hearing property and another transfer function for assigning the perceptual hearing property, and weights for the transfer function and the other transfer function are in positive correlation to the proportions of the desired component and the noise component in the corresponding first subband signal respectively, filters corresponding to the channels respectively, each of which is configured to apply the filter parameter corresponding to the channel and each of the first subband signals to obtain one of the second subband signals.

14. The audio processing apparatus according to claim 11, wherein the perceptual hearing property comprises a spatial hearing property or a temporal or frequency whitening property.

15. The audio processing apparatus according to claim 12, wherein the multi-dimensional auditory presentation method is a binaural auditory presentation method, and wherein each of the first transfer functions comprises one or more head-related transfer functions for assigning different spatial hearing properties.

16. The audio processing apparatus according to claim 12, wherein the multi-dimensional auditory presentation method is based on two stereo speakers, and wherein there is a low correlation between the second transfer functions corresponding to the same first subband signal.

17. The audio processing apparatus according to claim 11, wherein the proportions of the desired component and the noise component in each of the first subband signals are estimated as not greater than 0.9 and not smaller than 0.1 respectively.

18. The audio processing apparatus according to claim 11, wherein the proportions of the desired component and the noise component in each of the first subband signals are estimated based on a gain function or a probability.

19. The audio processing apparatus according to claim 12, wherein the multi-dimensional auditory presentation method is an ambisonics auditory presentation method, and wherein the first transfer functions are adapted to present the same sound source in a sound field.

20. The audio processing apparatus according to claim 11, further comprising:

a detector configured to detect an audio output device which is activated presently for audio rendering, and determine the multi-dimensional auditory presentation method adopted by the audio output device, and wherein the frequency-to-time transformer is further configured to transmit the signals for rendering to the audio output device.

* * * * *